US005197081A

United States Patent [19]

Fishman

[11] Patent Number: 5,197,081

[45] Date of Patent: Mar. 23, 1993

[54] MAGNETIC RETURN APPARATUS FOR CORELESS INDUCTION FURNACES

[75] Inventor: Oleg Fishman, Maple Glen, Pa.

[73] Assignee: Inductotherm Corp., Rancocas, N.J.

[21] Appl. No.: 528,663

[22] Filed: May 24, 1990

[51] Int. Cl.[5] ..... H05B 6/22

[52] U.S. Cl. ..... 373/152; 373/138; 373/150; 373/151; 373/154; 373/159; 219/10.67

[58] Field of Search ..... 373/152, 151, 153, 154, 373/156, 142, 144, 159, 150, 164, 138, 140; 219/10.67

[56] References Cited

U.S. PATENT DOCUMENTS

| | | | |
|---|---|---|---|
| 1,682,388 | 8/1928 | Lincoln | 373/151 |
| 1,743,956 | 1/1930 | Bunet | 373/159 |
| 1,834,725 | 12/1931 | Northrup | 373/150 |
| 1,879,360 | 9/1932 | Linnhoff | 373/151 |
| 2,667,524 | 1/1954 | Dreyfus et al. | 373/152 |
| 3,004,091 | 10/1961 | Tama et al. | 373/153 |
| 3,320,348 | 5/1967 | Seulen et al. | 373/164 |
| 3,700,779 | 10/1972 | Pomey | 373/140 |
| 3,704,336 | 11/1972 | Synnestvedt | 373/153 |
| 3,811,001 | 5/1974 | Lether | 373/152 |
| 3,875,322 | 4/1975 | Sundberg | 373/152 |
| 4,622,679 | 11/1986 | Voss | 373/152 |
| 4,969,158 | 11/1990 | Larson et al. | 373/152 |

*Primary Examiner*—Bruce A. Reynolds
*Assistant Examiner*—Tu Hoang
*Attorney, Agent, or Firm*—Seidel, Gonda, Lavorgna & Monaco

[57] ABSTRACT

An apparatus for directing electromagnetic flux near an induction coil comprises a loop-shaped member adapted to conduct electromagnetic flux, defining an axis parallel to the central axis of the induction coil and extending substantially the length of the coil. The loop-shaped member acts as a return circuit for minimizing a stray magnetic field external to the coil.

10 Claims, 4 Drawing Sheets

FIG. 6
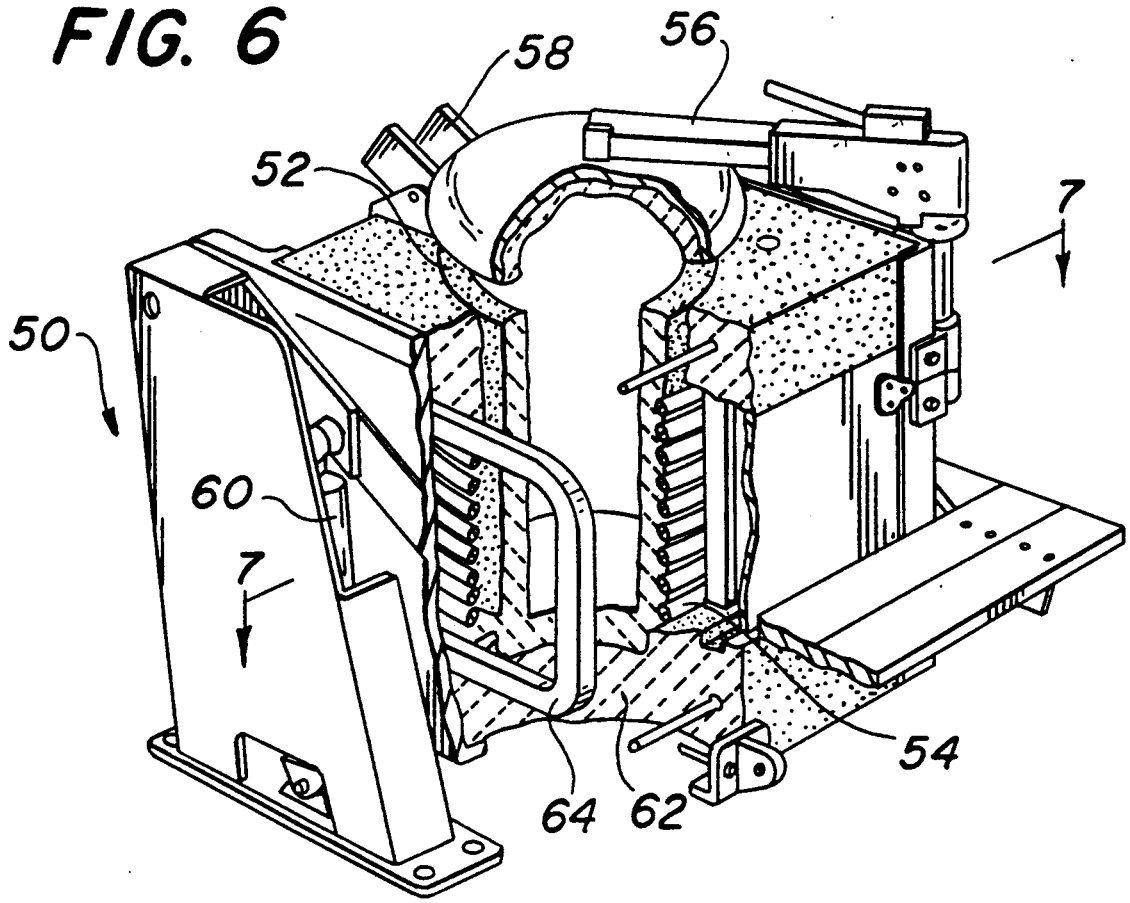
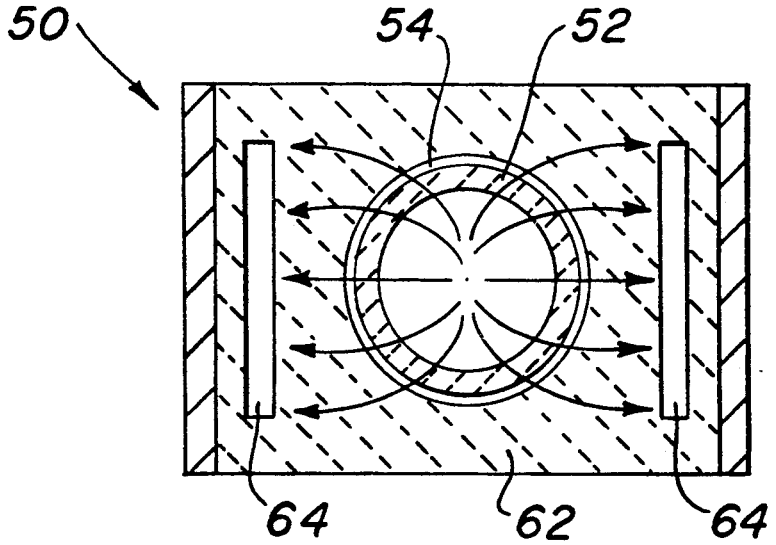
FIG. 7

MAGNETIC RETURN APPARATUS FOR CORELESS INDUCTION FURNACES

FIELD OF THE INVENTION

The present invention relates to a magnetic return apparatus for a coreless induction furnace, and more particularly to an induction furnace with toroidal yokes.

BACKGROUND OF THE INVENTION

Induction furnaces for heating or melting metals operate on the principle of inducing eddy currents in the metal charge to be heated. The eddy currents cause the metal charge to act as its own heat source by the $P=I^2R$ heating principle. The eddy currents are induced in the metal charge by passing alternating current through a coil disposed near or around the metal charge. In a coreless induction furnace, the metal charge is typically of a generally cylindrical shape and is disposed inside the coil, so that the metal charge itself acts as the core.

Coreless induction furnaces in common use today often include induction coils of copper tubing adapted to allow a liquid coolant to flow therethrough. The copper tubing conducts the alternating current which produces the electromagnetic field inside the furnace to create the eddy currents in the metal charge. The copper tubing also serves to support the furnace lining. The furnace lining is typically a refractory material and forms a cylindrical reservoir for the molten metal. Running water or other liquid coolant flows through the copper tubing of the coil to remove the heat conducted through the refractory material and the heat generated by the coil current.

FIGS. 1*a* and 1*b* are partial cross-sectional views through two prior art induction furnaces. Each furnace comprises an induction coil 12 which defines a volume in the furnace which receives the metal charge to be heated. When alternating current is passed through the coil 12, a magnetic field is generated, shown in each figure by the pattern of dotted lines which represent magnetic flux lines. The portion of the magnetic field in the interior of the coil passes through the refractory lining or crucible 26 and through the metal charge to be heated. However, a magnetic field of substantially the same magnitude as the field passing through the metal charge extends outward from the exterior of the coil 12.

In large coreless induction furnaces, the hydrostatic pressure of molten metal is usually so large that the coil 12 alone can not support the molten metal bath. To prevent the furnace from being destroyed by the heat and mass of the melting metal, the coil and refractory lining are usually placed within a steel shell 20. The steel shell 20 provides physical support to the coil 12 and the refractory lining 26. However, there are certain problems associated with steel shells.

Even if the outer shell 20 is not ferromagnetic but merely conductive, the magnetic field on the exterior of the coil will cause eddy currents to flow through the shell 20, thereby heating the shell in the same manner as the metal charge inside the coil. This stray magnetic field may also affect other machinery and apparatus in the vicinity of the furnace, and further represents wasted energy. The stray field lowers the power factor of the furnace and reduces the power input per ampere turn in the coil of the furnace inductor, thus limiting the output of any given furnace.

Certain techniques are known in the prior art to protect the top and bottom of the furnace. One common design feature is extra coil turns on the ends of the coil, extending beyond the axial length of the crucible. The extra turns include cooling means but do not carry any current. These non-current-carrying turns are shown as having a round cross-section at 16 and 18 in FIGS. 1A and 1B, as opposed to the current-carrying turns 14, which are shown with a square cross-section. It can be seen that the lower non-current-carrying turns 18 are disposed below the bottom of the crucible, and the top turns 16 are disposed above the top level of the metal charge. This construction of the coil has proven effective in limiting the temperature around the furnace.

Another common technique for reducing the extent of the stray magnetic field outside the induction coil is the use of magnetic shunts, or yokes. As shown in FIG. 1B, yoke 30 is an elongated member disposed outside and adjacent to the coil. Furnaces usually include a plurality of such yokes. Each yoke 30 is of such a length so that magnetic field lines extending outward from the top and bottom of the coil enter into the yoke 30 and pass from one end of the yoke to the other, instead of straying beyond the yoke to the shell 20. Yokes are traditionally assembled from long pieces of transformer steel; that is, a plurality of laminations of steel with insulating layers therebetween. Because transformer steel has a greater magnetic permeability than air, the stray magnetic field will pass through each of the yokes in preference to the surrounding air, with the effect that fewer magnetic field lines will penetrate the outer shell 20, as seen in FIG. 1B.

The width and number of yokes are typically selected so that all of the yokes together cover about 50% of the coil circumference. A common design parameter for induction furnaces with straight (or "stacked") yokes is:

$$W = \tfrac{1}{2}\pi \cdot D/N$$

where W is the yoke width, D is the coil diameter, and N is the number of yokes.

A prior art coreless induction furnace with transformer steel stacked yokes is shown in detail in FIG. 2. A portion of the coil 12 is shown with two yokes 30. The yokes 30 are usually distributed evenly around the entire coil in a similar fashion. In addition to conducting the electromagnetic field, the yokes also provide physical support to the sides of the furnace.

It has been found in the prior art that even though the stacked yokes may be effective in reducing the extent of the stray magnetic field, they do not effectively prevent excessive heat generation in the coil and shell. Magnetic flux coming out of the coil between the yokes is split in the air and enters the yokes obliquely to the orientation of the laminations, as can be seen by the flux arrows 24 in FIG. 2. Consequently there is a great deal of crossing of flux lines where the magnetic field enters and exits the yokes, i.e. at the top and bottom ends of the yokes. The unevenness of the flux lines within the laminations causes eddy currents, with resulting excessive heat within the yokes themselves. Prior art induction furnaces commonly require liquid cooling means for the yokes themselves, such as the plurality of tubes 32 disposed along each of the yokes 30 in FIG. 2, in addition to the cooling system in the coil. Water or other liquid coolant flows through these tubes 32, cooling the yokes 30. The tubes 32 are held against the yoke 30 by brackets 34. The measures that must be taken to remove the excess heat in the yokes increase the cost of the furnace and also reduce furnace efficiency.

An additional disadvantage of straight or "stacked" yokes is that the yokes do not cover 100% of the surface of the side walls of the furnace toward the ends of the coil, and therefore do not completely protect the shell.

It is an object of the present invention to provide an apparatus for reducing the stray magnetic current associated with a coreless induction furnace that is more effective than prior art yokes, and which may be manufactured relatively inexpensively.

SUMMARY OF THE INVENTION

The present invention is an apparatus for directing electromagnetic flux near an induction coil. The apparatus comprises a loop-shaped member adapted to conduct electromagnetic flux, defining an axis parallel to the central axis of the induction coil, and extending substantially the length of the coil.

In the preferred embodiment of the invention, an induction furnace for the heating of a metal charge including an induction coil, defining a central axis and an interior space adapted to accept the metal charge therein, comprises at least one yoke disposed adjacent to the exterior of the induction coil, the yoke including a loop member extending along an axis parallel to the central axis of the coil substantially the length of the coil.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown

FIG. 6 is a cutaway perspective view showing a yoke of the present invention in use in a small induction furnace.

FIG. 7 is a simplified cross-sectional view through the furnace of FIG. 6, taken along lines 7–7 of FIG. 6.

DETAILED DESCRIPTION OF THE INVENTION

Figure 3:
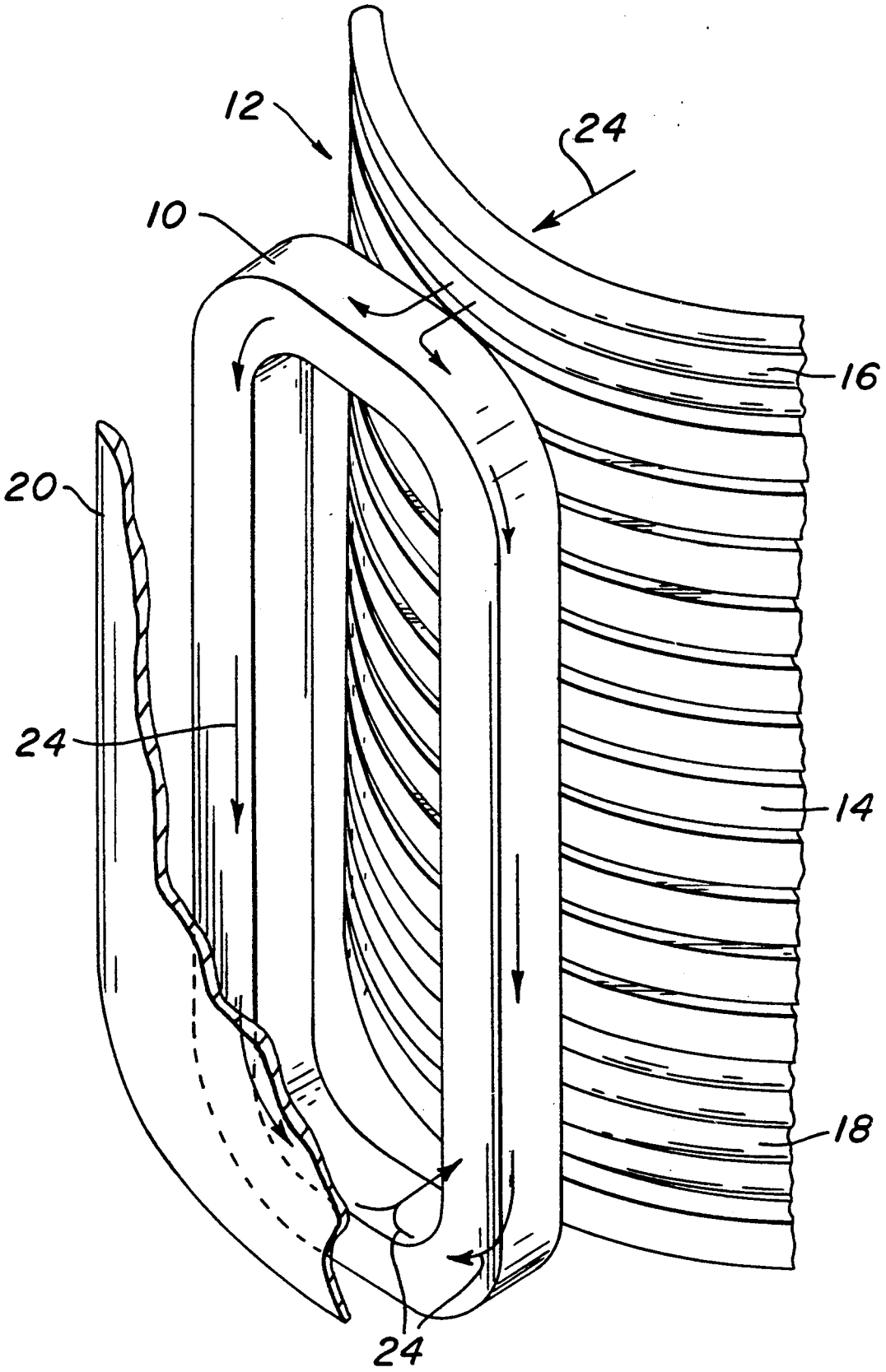
FIG. 3 is a simplified cutaway view showing the operating principle of the yoke of the present invention.

Referring to the drawings, in which like numerals indicate like elements, FIG. 3 shows a yoke 10 of the present invention disposed adjacent an induction coil generally marked 12. The induction coil 12 includes a central portion 14, having a plurality of turns through which alternating current passes, plus upper portion 16 and lower portion 18, which are additional coil turns but which are not adapted to have current passing therethrough. These extra turns 16 and 18 are added to extend the length of the furnace, support the refractory lining, and cool the top and bottom section of the lining. As mentioned above, the coil 12 may comprise hollow tubing through which a liquid coolant may flow.

When alternating current is passed through the active central portion 14 of the coil 12, magnetic fields are generated both inside and outside the coil. The magnetic field inside the coil passes through a metal charge to be heated, causing eddy currents that heat the metal charge through the $P=I^2R$ heating principle.

Figure 1A:
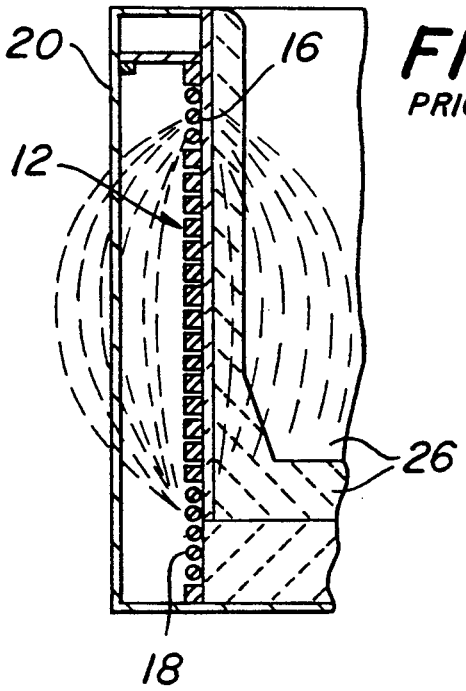
FIG. 1A PRIOR ART
FIGS. 1A and 1B are diagrams of prior art furnaces illustrating the principle of operation of a yoke in an induction furnace.
Figure 1B:
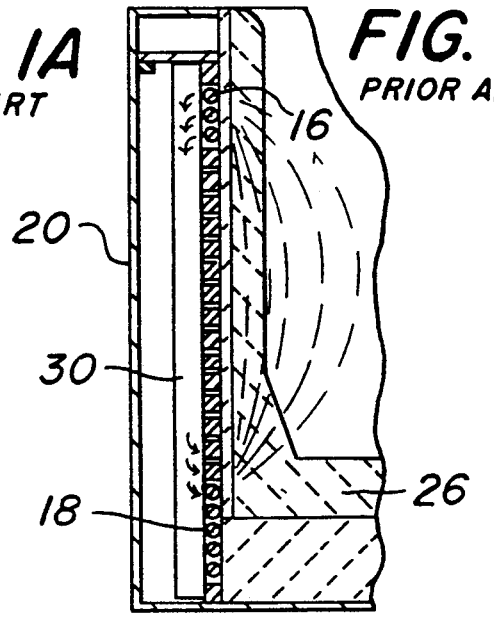
FIG. 1B PRIOR ART

The magnetic fields in the active portion 14 of the furnace gradually fan out outside the coil through the top and bottom sections of the coil, as shown in FIG. 1A. Thus, the magnetic lines toward the top and bottom of the furnace are perpendicular to the coil 12. In the active portion 14 of the coil, the field between coil 12 and the outside shell 20 is relatively weak. The strongest concentrations of the magnetic field occur at the top and bottom of the coil 12, where the field lines turn and fan out from the coil.

Figure 2:
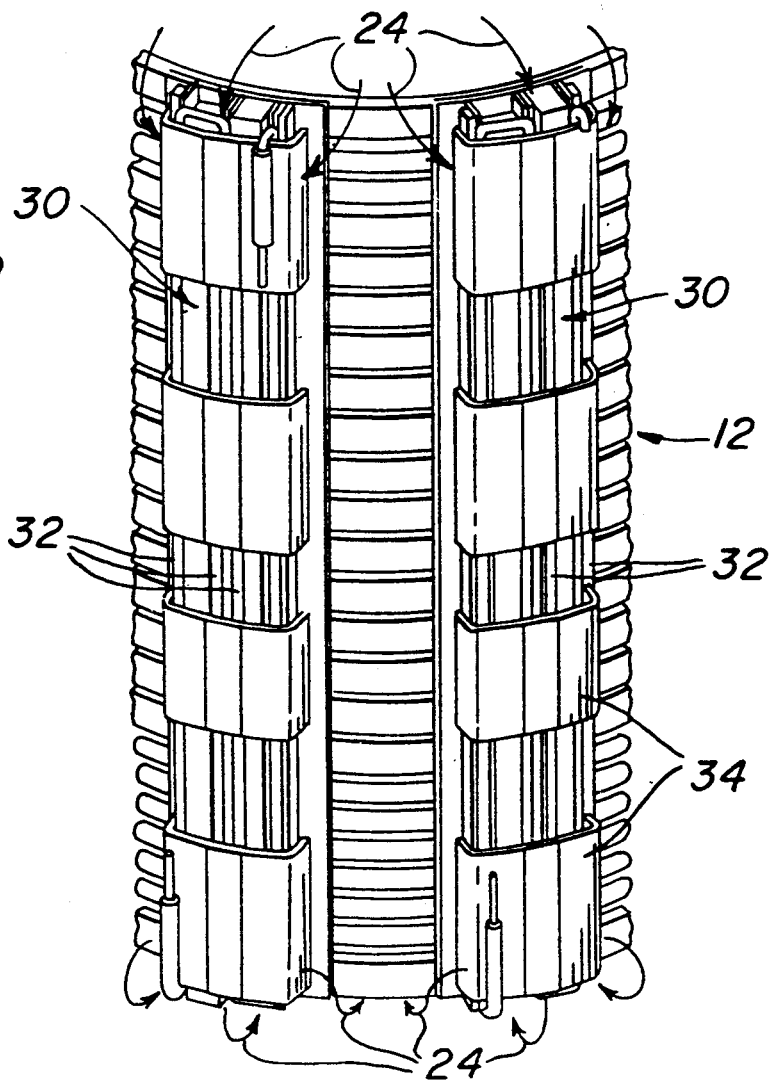
FIG. 2 PRIOR ART
FIG. 2 is a partial perspective view showing the straight, or stacked, yokes of the prior art, disposed around an induction furnace.

A representative bundle of field lines is shown by the arrows 24 being emitted from the top of the coil 12 entering the yoke 10 at the top, passing down through the vertical portions of the yoke and re-entering the coil 12 at the bottom. (Of course, the magnetic field lines 24 are not in fact "moving", but rather the arrows are to show a uniform direction of the field in a magnetic north-south sense.) Because the top portion of the yoke 10 is substantially parallel to the direction of the top coils 6, the magnetic field lines may enter the yoke 10 without the significant deformation that occurs with the straight shunts in FIG. 2. Once inside the yoke 10, the field lines turn and follow the path defined by the vertical portions of the yoke to the bottom part of the yoke. At the bottom of the yoke, the field lines turn again and leave the yoke perpendicular to the coil turns. In the passage through the yoke 10, the magnetic lines 24 cross each other only minimally, minimizing eddy current losses within the yoke. Because there are few eddy currents in the yoke, very little heating will occur within the material of the yoke 10. Therefore external cooling means are usually not needed for the yoke 10 itself. The shell 20 is protected by yoke 10 from the stray magnetic field lines, and therefore shell heating is also reduced. These reduced losses result in an increase in furnace efficiency.

Figure 4:
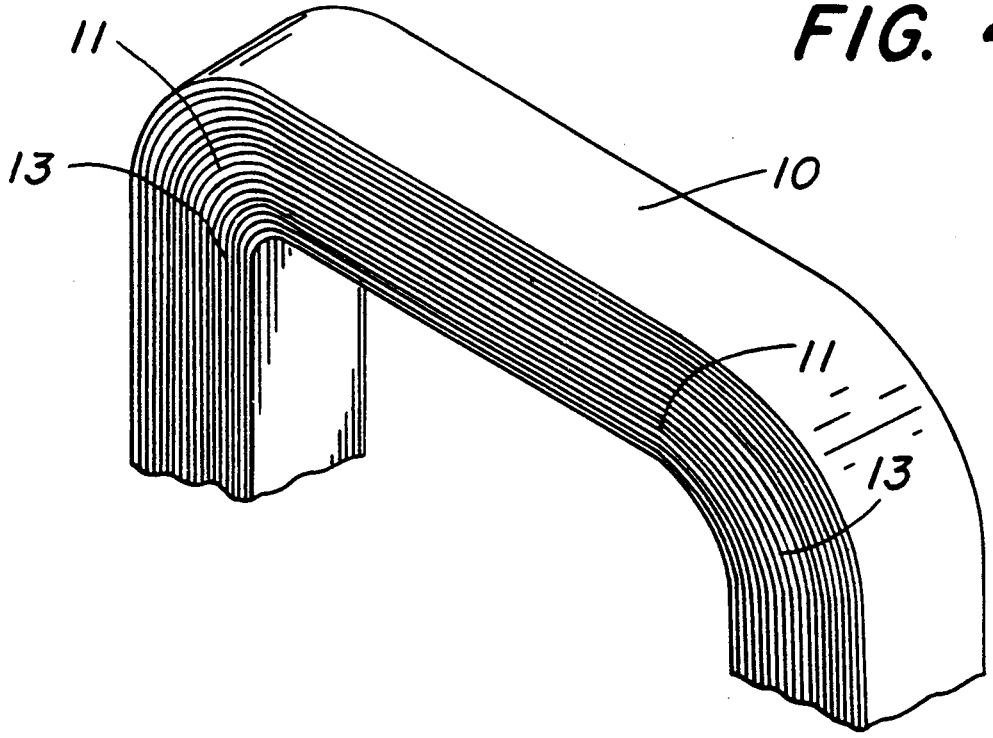
FIG. 4 is a detailed view of the structure of the yoke of the invention.

FIG. 4 shows a portion of the yoke 10 in detail. The yoke 10 comprises a plurality of magnetically permeable layers 11, with layers of insulation 13 therebetween. As is known in the art, such a "transformer steel" construction allows the easy passage of magnetic flux therethrough, while inhibiting the heating effect caused by eddy currents through the yoke 10. As is known in the art, the energy associated with eddy currents in a solid conductor is related to the length within the conductor through which an eddy current may travel; e.g., when eddy currents are induced in a cylinder, the magnetic field and heat energy are most intense around the outer skin of the cylinder because eddy currents are afforded the longest path to travel there, as opposed to some hypothetical path deeper within the cylinder. By laminating the yoke and interspacing the laminations of conductive material with insulating layers, the possible paths of eddy currents are minimized in length, and therefore the heat associated with the eddy currents is also minimized.

Another significant advantage of a loop-shaped yoke made of transformer steel is that such a loop structure is very easy to manufacture. A length of transformer steel tape (having a conductive layer bound to an insulating layer) is simply wound repeatedly to obtain the yoke shape. This manufacturing technique is generally less expensive than the technique for manufacturing stacked yokes, since relatively fewer cuts would have to be made in a quantity of transformer steel tape.

Figure 5:
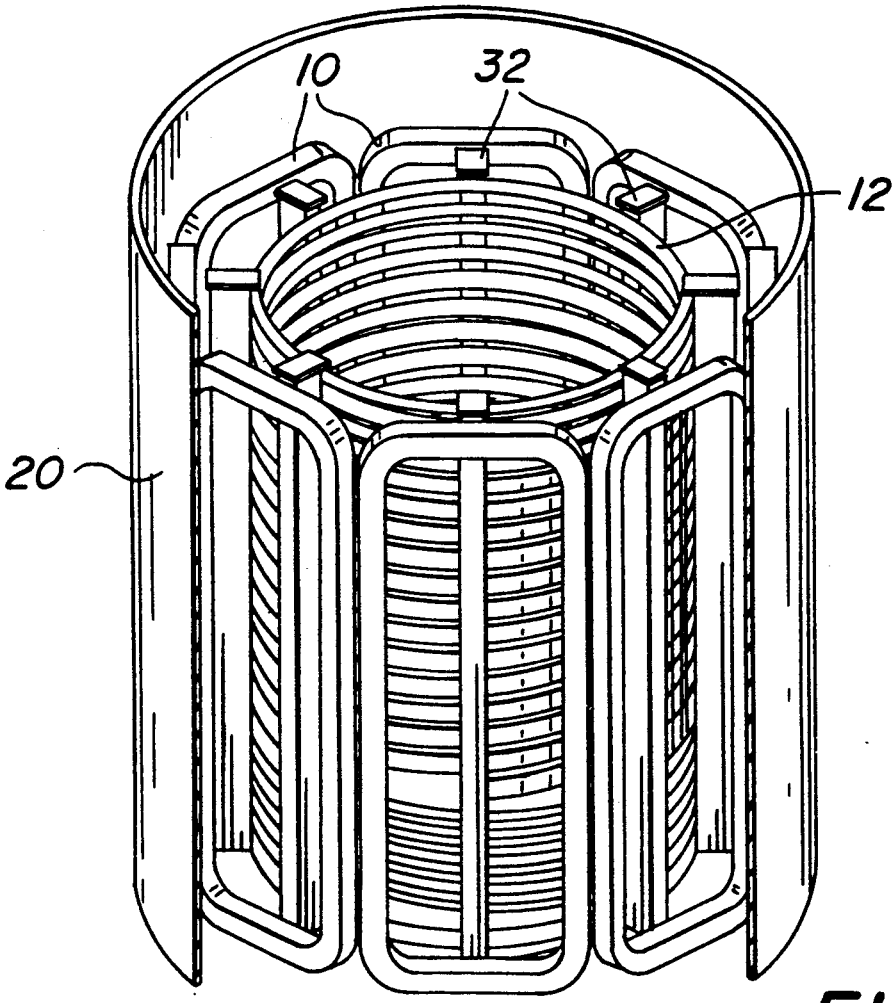
FIG. 5 is a cutaway view of an induction furnace, showing a plurality of the yokes of the present invention.

FIG. 5 shows an induction furnace having a plurality of yokes 10 distributed evenly around the coil 12. Each yoke 10 is preferably of a generally rectangular-toroidal shape as shown, as this shape provides the best exposure to the concentrated flux lines at the ends of the coil. The arrangement of yokes 10 provides substantially complete coverage around the circumference at the top and bottom of the coil 12. Thus, substantially all of the magnetic field lines which fan outward at the ends of the coil will pass through the horizontal sections of the yokes 10. Once inside one of the yokes 10, the field lines travel through the vertical portions of the yoke as shown in FIG. 3. The yokes 10 are preferably mounted on the inner surface of the shell 20. Support members 32 are disposed between the coil and the yokes. The supports 32 may be are typically wooden blocks with copper caps on their top and bottom ends.

The physical dimensions and properties of the yoke of the present invention will depend, for maximum efficiency, on the properties of the induction coil itself. Among the parameters affecting the proper dimensions of the yokes include the voltage and frequency of the power in the induction coil, and the number of turns in the induction coil. For the furnace shown in FIG. 5, having a plurality of toroidal distributed substantially continuously around the sides of the coil, the proper dimensions of the yokes may be calculated as follows. The calculation begins with Maxwell's equation:

$$U = n\frac{d\phi}{dt} \tag{1}$$

where:
U = furnace voltage
n = number of turns in the induction coil, and
$\phi$ = total magnetic flux associated with the induction coil.

Assuming the voltage through the induction coil is a periodic sinusoidal function, the value of the magnetic flux $\phi$ can be calculated thus:

$$\phi = 1/n \int U dt = \frac{1}{\omega n} U_{max}\cos(\omega t) \tag{2}$$

or $$\phi_{max} = \frac{U\,\mathrm{max}}{\omega n} = \frac{|U|}{\sqrt{2}\ \pi f n}$$

where:
|U| = RMS voltage in the coil, and
$\omega = 2\pi f$ = radial frequency of the voltage in the coil Any yoke will have certain physical properties associated with it which limit the effective flux density $B_{max}$ which may pass through the yoke before the yoke reaches magnetic saturation. That is, beyond a certain flux density B the yoke will not be able to conduct any further flux. Obviously, the properties and dimensions of the yoke must be matched to the total flux being generated by the coil. Using as an example the arrangement shown in FIG. 5, it may be assumed that all of the flux from the coil is in a position to pass through the yokes. Total flux is determined by the product of the flux density B times the area through which the flux is to pass. For the furnace of FIG. 5, this area is represented by a "cross-section" through all the yokes at some point near the center of the furnace, so that the two sections of each yoke parallel to the axis of the furnace are taken into consideration. Assuming that all of the flux from the coil flows through the yokes, it can be stated that:

$$\phi_{max} = A * B_{max} \tag{3}$$

where:
A = cross section of all yokes, and
$B_{max}$ = maximum flux density permitted through the yoke material without saturation From (2) and (3), A can be computed:

$$A = \frac{U}{\sqrt{2}\ \pi f n B_{max}} \tag{4}$$

If K yokes are used, then the cross section of each yoke will be:

$$a = \frac{U}{2\sqrt{2}\ \pi f K n B_{max}} = \frac{U}{8.89 f K n B_{max}} \tag{5}$$

In equation (5) above, the "2" at the beginning of the denominator of the first ratio reflects the fact that each yoke in cross section includes two paths for the conduction of flux.

In designing a yoke, it is convenient and reasonable to assume that a cross section of the yoke at any point is generally square. That is, the stack height of a given number of layers of transformer tape in the yoke is approximately equal to the width of the transformer tape. This assumption of a square cross-section simplifies the design of the yoke. If the required cross-section of each yoke is the area from equation (5) above, the transformer tape should have a width l where $$l = \sqrt{a}.$$

Since transformer tape of the preferred width l may not be readily available, a reasonable approximation is satisfactory. Given a transformer tape of a width l, the necessary stack height h may be given as $$h = a/l.$$

An alternative configuration of the toroidal yokes may be used for smaller induction furnaces, wherein the need for high efficiency and prevention of heat escape are less crucial. FIG. 6 shows a relatively small induction furnace of a design similar to that sold under the trade name "DURA-LINE®". ("DURA-LINE®" is a registered trademark of Inductotherm Corp.) The furnace 50 illustrates the typical parts of an induction furnace, such as the refractory lining 52, forming a cavity in which the metal charge to be heated is placed, and the induction coil 54. Other features common to induction furnaces may be included as well, such as lid mechanism 56, spout 58, and tilting mechanism 60. Furnaces of this size are often designed without a steel outer shell and without yokes of any kind. It is common to encapsulate such small furnaces in a fireproof nonmetal box 62. The box 62 is typically made of fireproof material not containing asbestos. The coil 54 produces a magnetic field that closes the magnetic loop of flux lines outside the furnace through the air space around the furnace and through any nearby metallic structures.

Although the yokes of the present invention may be adapted for use in furnaces of any design, it is relatively simple to modify the existing design of a "DURA-LINE®" type furnace by adding toroidal yokes, such as that shown at 64, on two sides of the coil 54. The presence of the toroidal yokes, even if they do not closely follow the shape of the coil turns, may still be effective in reducing stray magnetic field and thereby increasing the efficiency.

FIG. 7 is a simplified cross-sectional view of the furnace 50, showing the relationship between the coil 54 and the two yokes 64. Even though the magnetic field must bend slightly to enter the two yokes 64, the degree of bending is slight and does not produce a significant amount of crossing of field lines. The crossing of magnetic lines within the structure of the box 62 will not cause eddy currents and resulting heating because the box 62 is not itself conductive. No matter what the exact improvement in efficiency, a furnace having the two yokes 64 would still be more efficient than an equivalent furnace with no toroidal yokes at all.

Regardless of the particular embodiment, the present invention provides an efficient, effective and relatively inexpensive apparatus for reducing stray electromagnetic flux and the heating associated therewith on the outside of an induction coil. The toroidal structure of the yoke of the present invention is effective in directing the electromagnetic flux passing along the outside of an induction coil with a minimum of crossing of field lines which cause undesired heating outside the coil. The toroidal structure also facilitates substantially continuous coverage of the circumference of the coil at the ends of the coil, where the concentration of magnetic field line is most intense. Further, the toroidal structure has the advantage of being inexpensive to manufacture, as it may be wound from a single long length of transformer steel.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus for directing electromagnetic flux adjacent a generally cylindrical induction coil having a central axis, comprising a member in the shape of a closed loop, disposed entirely external to the circumference of said cylindrical induction coil, and adapted to conduct electromagnetic flux, the member extending along an axis parallel to the central axis of the induction coil and extending substantailly the axial length of the coil.

2. Apparatus as in claim 1, wherein the member comprises a plurality of layers of electromagnetically conductive material with insulating layers between.

3. Apparatus as in claim 1, wherein the member is in the shape of a generally rectangular toroid.

4. An induction furnace for heating a metal charge, comprising:

a generally cylindrical induction coil, having a central axis and defining an exterior and an interior volume for receiving a crucible for containing a metal charge therein;

at least one yoke adapted to conduct electromagnetic flux disposed adjacent the exterior of the induction coil, said at least one yoke including a member in the shape of a closed loop, disposed entirely external to the circumference of said cylindrical induction coil, and extending substantially the axial length of the coil along an axis parallel to the central axis of the induction coil.

5. A furnace as in claim 4, wherein the member comprises a plurality of layers of electromagnetically conductive material with insulating layers therebetween.

6. An induction furnace as in claim 4 wherein said at least one yoke is in the shape of a generally rectangular toroid.

7. An induction furnace as in claim 4, having a plurality of yokes, the yokes being disposed as preselected locations around the circumference of said generally cylindrical coil.

8. An induction furnace for heating a metal charge, comprising:

a generally cylindrical induction coil, having a central axis and defining an interior volume for receiving a crucible for containing a metal charge therein;

a fireproof, non-conductive box substantially encapsulating the induction coil; and at least one yoke substantially embedded within said box, said at least one yoke including a member in the shape of a closed loop, disposed entirely external to the circumference of said cylindrical induction coil, and adapted to conduct electromagnetic flux and extending substantially the axial length of the coil along an axis parallel to the central axis of the coil.

9. An induction furnace as in claim 8, wherein the member comprises a plurality of layers of electromagnetically conductive material with insulating layers therebetween.

10. An induction furnace as in claim 8, wherein the member is in the shape of a generally rectangular toroid.

* * * * *